US005645492A

United States Patent [19]

Anderson

[11] Patent Number: 5,645,492

[45] Date of Patent: Jul. 8, 1997

[54] SELECTABLE TARGET PUTTING TRAINER

[76] Inventor: Kevin Anderson, 11500 White Oak Ct., Herndon, Va. 20170

[21] Appl. No.: 721,376

[22] Filed: Sep. 26, 1996

[51] Int. Cl.[6] ..... A63B 69/36

[52] U.S. Cl. ..... 473/185; 473/195

[58] Field of Search ..... 473/180, 185, 473/189, 173, 174, 186, 187, 195

[56] References Cited

U.S. PATENT DOCUMENTS

| | | | |
|---|---|---|---|
| 1,112,075 | 9/1914 | Lush | 473/189 |
| 1,693,474 | 11/1928 | Burt | 473/185 |
| 1,736,447 | 11/1929 | Kindt et al. . | |
| 1,903,480 | 4/1933 | Ryan | 473/180 |
| 3,114,556 | 12/1963 | Miller | 473/185 |
| 4,667,964 | 5/1987 | Hickey . | |
| 4,750,744 | 6/1988 | Michalec . | |
| 4,861,033 | 8/1989 | Miner | 473/180 |
| 4,906,006 | 3/1990 | Sigunick . | |
| 5,154,426 | 10/1992 | Black . | |
| 5,205,559 | 4/1993 | Plopper . | |
| 5,407,203 | 4/1995 | Jones | 473/185 |
| 5,415,397 | 5/1995 | Van Holt, Jr. . | |
| 5,478,071 | 12/1995 | Barrs et al. . | |

OTHER PUBLICATIONS

Wittek Golf Catalogue, "Training Aids".

The Golf Works Catalogue, "The Medicus Pro Driver, 5 Iron and Putter", p. 17.

*Primary Examiner*—Mark S. Graham

*Attorney, Agent, or Firm*—Nikaido, Marmelstein, Murray & Oram LLP

[57] ABSTRACT

A putting trainer having a planar base with a cover rotatably disposed over the planar base. The base has a plurality of target openings therein, with each of the openings having a different width. The cover has a single opening, and can be rotatably attached to the planar base so that an opening of a desired size can be selected as a target for putting training.

13 Claims, 3 Drawing Sheets

SELECTABLE TARGET PUTTING TRAINER

BACKGROUND OF THE INVENTION

1. Field of the Invention

The present invention is directed to a training device for improving aim and alignment in putting and chipping in the game of golf. The invention can be used by placing the invention on a simulated putting surface such as on a carpet or on closely cut grass, or can be placed over a golf putting cup on a practice green, and therefore used in cooperation with the putting cup. The invention enables a golfer to improve alignment and aim during putting and chipping by using a target of diminishing size such that more accuracy is required in order to sink a practice putt.

2. Description of the Related Art

Numerous types of putting trainers are known which utilize a simulated putting green and a golf cup or target which can be used on suitable surfaces indoors or outdoors. Difficult shots can be simulated by using inclined surfaces. U.S. Pat. No. 4,906,006 discloses a stand-alone practice golf device wherein a putting hole is simulated by a molded or formed outer ring, and a plurality of inner rings can be selectively placed within the outer ring in order to reduce the target area, to require a golfer to aim at a smaller target to increase accuracy.

The outer ring creates a shallow simulated hole with a bottom surface which supports the concentric inner rings which are placed therein. The outer ring, therefore, must have a shoulder or a height which might not normally be encountered in the game of golf. This shoulder could require additional ball speed in order for the ball to roll over the shoulder and into the shallow cup, which could decrease the realism of the practice stroke. Additionally, the unused concentric rings must be stored or held by the golfer, and could be therefore subject to damage or misplacement. Furthermore, in order to provide a putting target with four different target sizes, a minimum of four separate parts are needed; these four parts include the outer ring/base assembly, providing a first, widest target, and one ring for each reduced target size which is desired.

SUMMARY OF THE INVENTION

The present invention provides a variable target golf putting trainer, in a first embodiment, which requires only one integrated piece to be manufactured, with a plurality of targets or target openings located at the periphery of this one integrated piece. The invention utilizes open apertures as targets for receiving the ball, and a bottom surface of the target is provided by the play surface, putting green, or carpet. In the alternative, the invention can be used in conjunction with a conventional putting cup on a putting green, by placing the selected target over an existing putting cup. The configuration of the invention prevents the need for a shoulder or other surface which can interfere with the realism of the practice stroke.

In another embodiment of the invention, a planar base having a plurality of targets is provided, with the planar base being a modified version of the base used in the first embodiment. A rotatable cover is placed over the planar base; the cover is rotatable such that the user can select one of the plurality of targets by rotating the cover until an opening in the cover corresponds to a selected target, based upon the desired level of practice accuracy. The targets have openings which vary in width from a maximum width which is slightly smaller than the diameter of a putting cup, to a significantly reduced width, while the cover has only a single opening of a predetermined width. The reduced width target is provided by the reduced width opening of the bottom portion aligning with the single opening of the top portion.

DETAILED DESCRIPTION OF THE PREFERRED EMBODIMENTS

Figure 1:
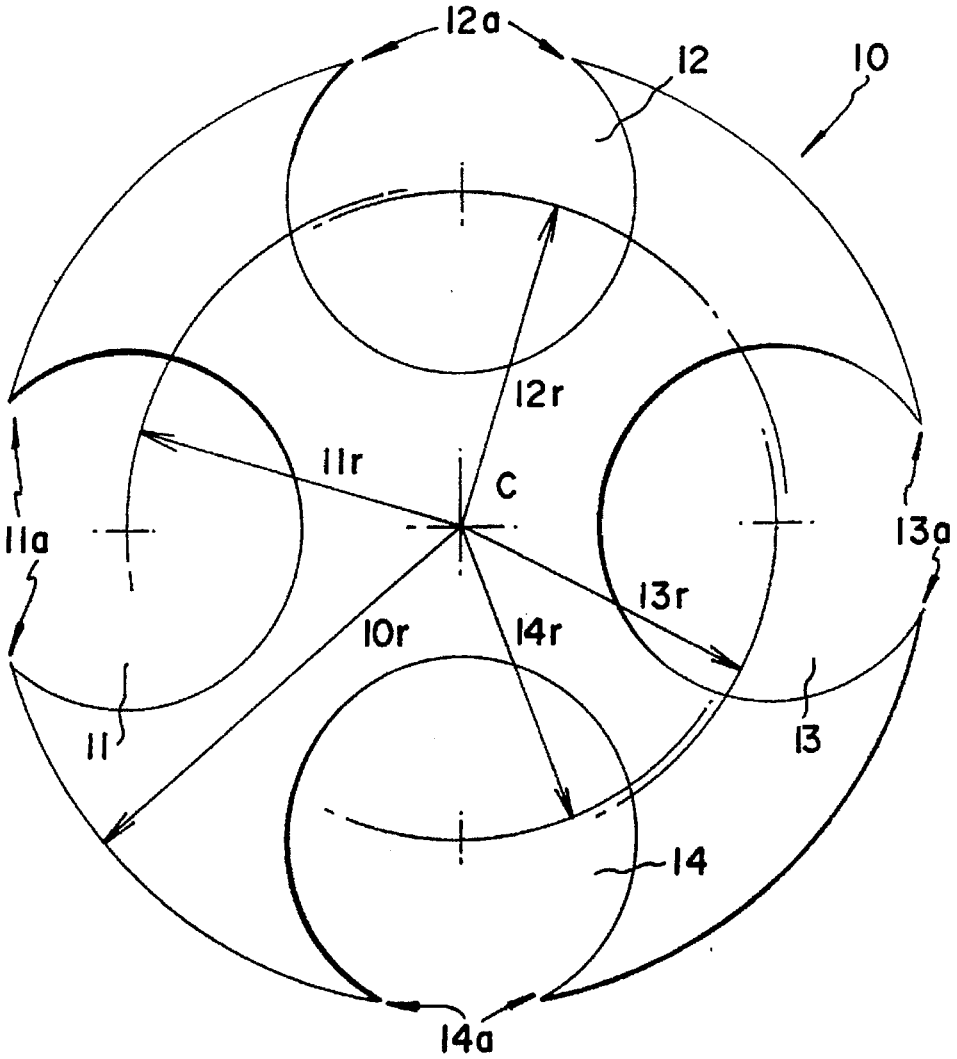
FIG. 1 is a top view of a first embodiment of the invention.

Referring to FIG. 1, a first embodiment of the invention is a one piece planar base 10 having a plurality of targets or target apertures 11–14 therein. Each aperture has a corresponding opening on an outer periphery of the planar base, designated as 11*a*, 12*a*, 13*a*, and 14*a*. In this embodiment of the invention, each of these apertures are circular in nature, and each have a maximum diameter of 4¼ inches. 4¼ inches is a standard diameter for a putting cup, based upon the current rules of the United States Golf Association. However, a center point of each of the apertures is at a different radial position on the planar base, so that the outer periphery of the planar base and an outer circumference of each aperture creates an opening 11*a*, 12*a*, 13*a*, and 14*a*, such that each of the openings has a different width. Each of the apertures has a geometric center thereof which is spaced a different distance from the center C of base 10, as illustrated by radial lines 11*r*, 12*r*, 13*r*, and 14*r*. The radius of the planar base remains essentially constant as radius 10*r*.

In a preferred embodiment of the invention, each target aperture 11–14 has a maximum diameter of 4¼ inches, and opening 11*a* has a width of 3⅝ inches, while opening 12*a* has a width of 3⅛ inches, opening 13*a* has a width of 2⅝ inches, and opening 14*a* has a width of 2⅛ inches.

The embodiment of FIG. 1 can be positioned such that a selected one of apertures 11, 12, 13, or 14 can be placed over a putting cup on a putting green, such that the opening of the selected aperture creates a diminished target size. In the alternative, planar base 10 of FIG. 1 can be placed on a carpet or other suitable surface and a user can select any one of target apertures 11, 12, 13, or 14 to act as a target.

Figure 2:
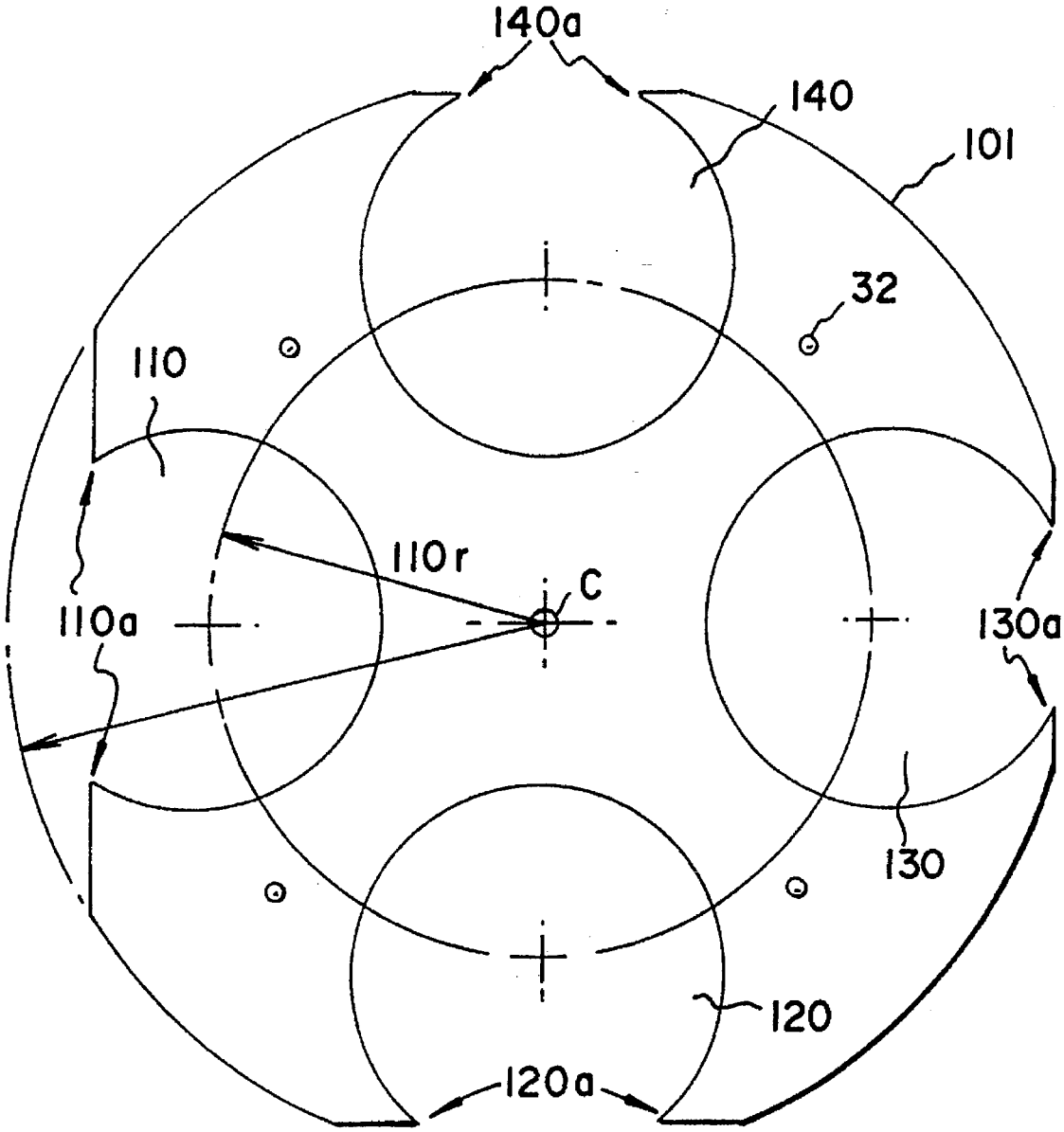
FIG. 2 is a top view of a bottom or base portion of a second embodiment of the invention.
Figure 3:
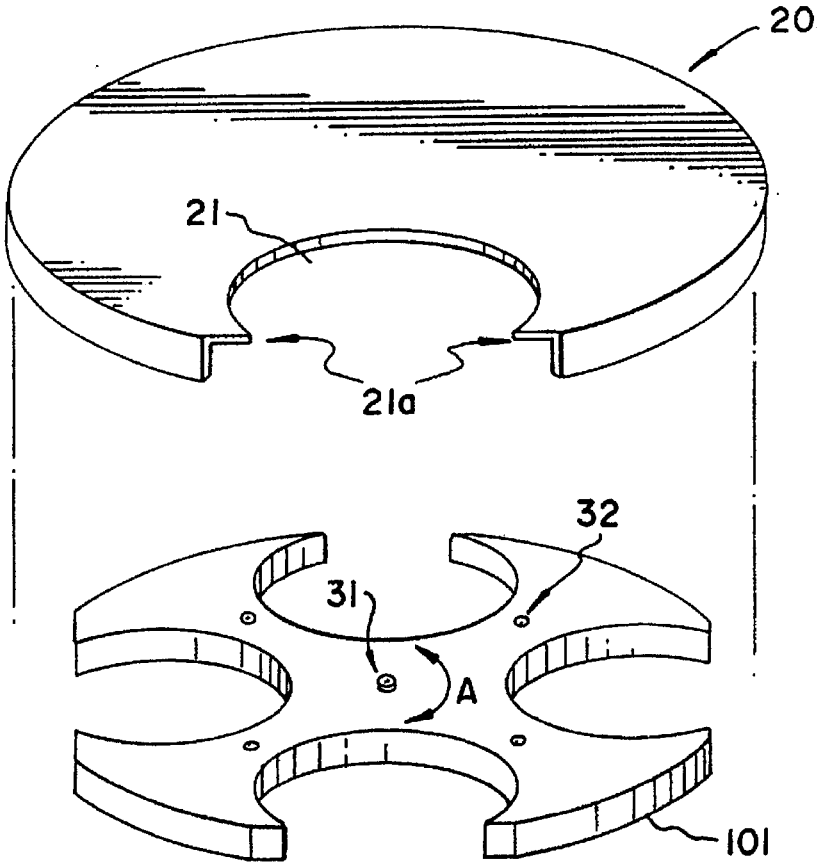
FIG. 3 illustrates an exploded view of the second embodiment of the invention.

FIGS. 2 through 5 illustrate a second embodiment of the invention. Referring to FIGS. 2 and 3, this second embodiment includes a planar base 101 as shown in FIG. 2, having a modified configuration based on base 10 of FIG. 1. Base 101 of FIG. 2 is a planar base having a substantially circular outer periphery, with a plurality of target apertures 110, 120, 130, and 140 disposed therein. All of these target apertures are disposed to have a center which is at a same radial distance 110*r* from the center C of planar base 101. In order for this planar base to provide different opening widths for the various target apertures, selected segments of the outer circumference of base 101 are trimmed off along selected chords as shown in FIG. 2 to enable each of openings 110*a*, 120*a*, 130*a*, and 140*a* to have a different width. Cover 20, having an inner diameter which corresponds to an overall diameter of planar base 101 is movably attached to planar base 10. Cover 20 includes a single aperture 21, which has a diameter and an overall shape which corresponds to a diameter and overall shape of a largest one of target openings 110*a*, 120*a*, 130*a*, and 140*a*. For example, aperture 21 in cover 20 could have a maximum diameter of 4¼ inches, with opening 21*a* having a width of 3⅝ inches. This would correspond to opening 110*a*.

Figure 5:
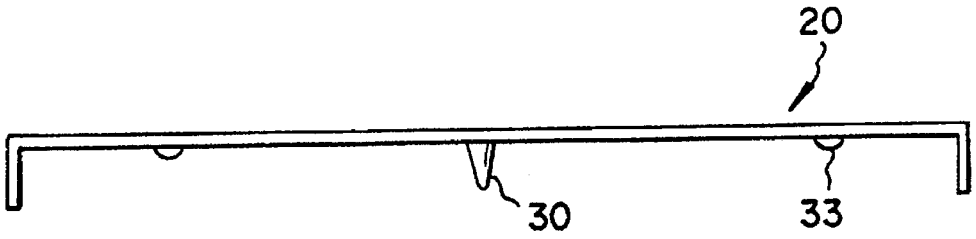
FIG. 5 illustrates a cross section of the top cover of the second embodiment of the invention.
Figure 4:
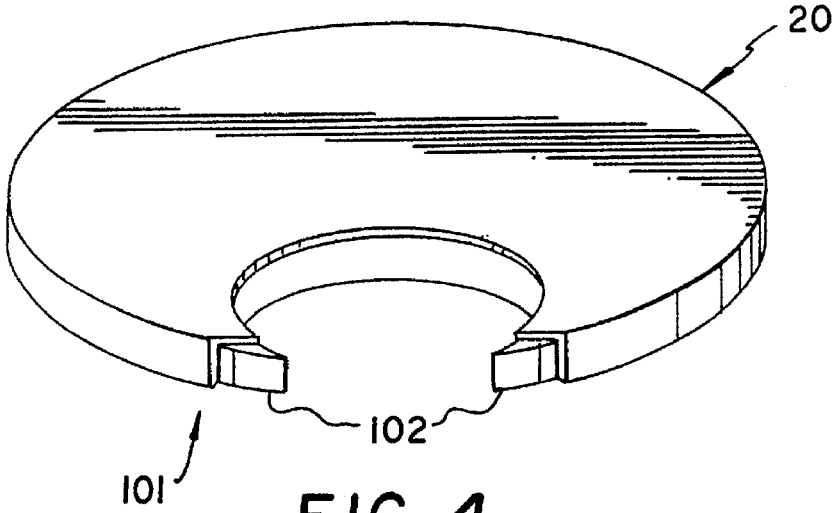
FIG. 4 shows an overall perspective view of the second embodiment of the invention.

Cover 20 can be, for example, pivotally attached to base 101 at corresponding pivot attachment points 30 and 31, so that cover 20 can rotate relative to base 101 around axis A. The pivotal attachment can be made by virtue of a pivot pin or rivet, interference fit of corresponding engagement elements, or other suitable connection means. The outer perimeter of cover 20 can be configured to frictionally engage an outer perimeter of base 101 in order to provide a secure and durable engagement of the cover and the base, while enabling relative rotation between the cover and the base. The single aperture in cover 20 requires the centers of apertures 110–140 to be at a common radius from center C of base 101. This will enable alignment of each of the apertures in the base with the single aperture in cover 20, as shown in FIG. 4. Recesses 32 can be provided in base 101, to correspond with dimples or projections 33 disposed on an inner surface of cover 20, as shown in FIG. 5. As pivot means 30 and 31 cooperate to allow cover 20 and base 101 to be rotated relative to each other, engagement and disengagement of projections 33 and recesses 32 results in a detent action, such that opening 21 can be snapped or clicked into place, in correspondence with a selected target aperture 110–140.

As different openings are selected, an untrimmed portion of base 101 can project outward past a trimmed portion of cover 20, and appear as claws or projecting points 102, as can be seen in FIG. 4. The size of the projecting portions 102 depends upon which of the target apertures 110, 120, 130 or 140 is selected.

Referring once again to FIG. 5, FIG. 5 illustrates an example of a cross section of cover 20, which includes rotating pin or rotating point 30 which is intended to engage a corresponding opening 31 in base 101. Pin 30 can be formed of a number of materials, including a screw, bolt, rivet, meltable plastic projection, etc.

A number of suitable materials can be used for the manufacture of a putting trainer according to the present invention. For example, the cover and the base can be molded of suitable plastic materials, composite materials, or other moldable materials. An alternative construction can be stamping or casting from metal, fashioning from wood, or other suitable construction based upon a desired market or desired application. An overall size for the diameter of the trainer base and/or the cover means can be approximately 11 inches. This size provides a significant amount of surface area on the cover means for the placing of advertisements, manufactures logos, origin information, or general golf information or indicia.

In use, a golfer may select a widest opening 110*a* on the planar base by rotating cover 20 so that aperture 21 corresponds to opening 110*a*. After obtaining a desired level of competency in hitting the largest target, the user can rotate cover 20 so that aperture 21 corresponds to a second largest opening 120*a*; since opening 120*a* has a width which is less than opening 110*a*, increased accuracy is needed in order to allow the golf ball to enter target aperture 120. After desired competency with opening 120*a*, the use can then rotate cover 20 to select opening 130*a*, and 140*a*, as desired. Sequentially selecting smaller target openings will improve putting accuracy, and assist in improving golf scores. This sequential improvement can be assisted by the golfer's concentration or focussing on a target point or focal point at the back of the target aperture. As the golfer's accuracy at hitting this target point improves, the golfer will be able to more consistently direct the ball through the smaller openings.

A thickness of the planar base must be selected to be thick enough such that the ball will not roll over the planar base in a situation where a ball is improperly aimed, or where a ball properly enters an aperture and hits the rear portion thereof. The planar base, therefore, must be thick enough to deflect errant shots, thereby allowing only accurately shot golf balls to pass through the selected opening into the target aperture.

It is to be understood that the above-described embodiments are disclosed as examples of the present invention, but are not intended to limit the scope of the invention. The invention is defined by the following claims.

I claim:

1. A putting trainer, comprising:

a planar base having a circular outer perimeter, said outer perimeter having a plurality of openings therein, with each of said plurality of openings having a different width, wherein each of said openings corresponds to an open portion of a corresponding circular aperture, wherein each corresponding circular aperture has a geometric center which is disposed by a selected radial distance from a center of the planar base, wherein each selected radial distance for each circular aperture is different, whereby the width of the opening is adjusted based upon a selection of the radial distance, the width of the opening corresponding to a width of a segment of each circular aperture which is outside of the perimeter of the base.

2. A putting trainer, comprising a planar base having an outer perimeter, said outer perimeter having a plurality of openings therein, with each of said plurality of openings having a different width; and cover means movably attached to said planar base, said cover means for covering said planar base, said cover means including one opening therein, wherein said cover means is moveable so that said one opening can be moved to correspond to a selected one of said plurality of openings in said planar base.

3. A putting trainer as recited in claim 2, wherein said cover means is rotatably attached to said planar base, and wherein said one opening in said cover means can be selectively rotated to correspond to the selected one of the plurality of openings in the planar base.

4. A putting trainer as recited in claim 2, wherein the outer perimeter of the planar base and an outer perimeter of the cover means substantially correspond to each other.

5. A putting trainer as recited in claim 2, wherein the outer perimeter of the cover means is circular.

6. A putting trainer as recited in claim 2, wherein a first of said plurality of openings is of a first width, and a second of said plurality of openings is of a second width smaller than said first width, and wherein a third of said plurality of openings is of a third width smaller than said second width, and wherein a fourth of said plurality of openings is of a fourth width smaller than said third width.

7. A putting trainer as recited in claim 2, wherein the planar base has a circular outer periphery, and wherein each of said openings corresponds to an open portion of a circular aperture in said planar base, wherein each circular aperture is of a same size and has a geometric center which is a same fixed distance from a center of the planar base, and wherein the widths of the openings are set by predetermined segments of the planar base adjacent each aperture being removed along a chord line, said predetermined segments determining the widths of the openings.

8. A putting trainer as recited in claim 2, wherein a first opening of said plurality of openings is 3⅝ inches wide, and other of said plurality of openings have a width which is less than 3⅝ inches.

9. A putting trainer as recited in claim 2, wherein a smallest of said plurality of openings is 2⅛ inches wide.

10. A putting trainer as recited in claim 2, wherein the one opening in the cover means has a width of 3⅝ inches.

11. A putting trainer as recited in claim 7, wherein each said aperture has a maximum diameter which is greater than the width of the opening thereof.

12. A putting trainer as recited in claim 7, wherein each aperture in said planar base is a circular aperture having a maximum diameter of 4¼ inches, and wherein each opening is less than 4¼ inches in width.

13. A putting trainer as recited in claim 2, wherein said opening in said cover means comprises an open portion of a circular aperture, said circular aperture having a diameter of 4¼ inches, and said opening having a width which is less than 4¼ inches.

* * * * *